United States Patent [19]

Ljungberg

[11] 4,226,184

[45] Oct. 7, 1980

[54] PRIMER

[75] Inventor: Sten H. Ljungberg, Stockholm, Sweden

[73] Assignee: Nitro Nobel AB, Gyttorp, Sweden

[21] Appl. No.: 885,578

[22] Filed: Mar. 13, 1978

[30] Foreign Application Priority Data

Mar. 18, 1977 [SE] Sweden ..... 7703136

[51] Int. Cl.[2] ..... C06C 5/06; F42B 3/00

[52] U.S. Cl. ..... 102/24 R

[58] Field of Search ..... 102/24 R

[56] References Cited

U.S. PATENT DOCUMENTS

| | | | |
|---|---|---|---|
| 1,512,714 | 10/1924 | Saucier | 102/24 R |
| 2,707,437 | 5/1955 | Noddin et al. | 102/24 R |
| 3,254,601 | 6/1966 | Griffith et al. | 102/24 R |
| 3,285,172 | 11/1966 | Foster | 102/24 R |
| 3,793,954 | 2/1974 | Johnston | 102/24 R |
| 4,000,696 | 1/1977 | Friant et al. | 102/24 R |
| 4,023,494 | 5/1977 | Barton et al. | 102/24 R |

*Primary Examiner*—Charles T. Jordan

[57] ABSTRACT

A pointed cap, which is press fit over the opening in the front end of a hollow, cylindrical primer cartridge, has an integral, tubular socket or detonator holder, which projects coaxially rearwardly from the pointed end of the cap. A cylindrical detonator is disposed to be press fit at one end into a socket so that the opposite end thereof projects coaxially in the cartridge over which the cap is secured, and into contact with the explosive material contained in the cartridge. In one embodiment the forward end of the socket opens on a fuse-protecting slot, which is formed transversely across the pointed end of the cap so that a fuse, which projects from the forward end of the detonator, can pass laterally out of one side of the slot and rearwardly along the outside of the cartridge. In other embodiments the pointed end of the cap is closed, and the fuse is curved rearwardly within the cap and passes rearwardly between the edge of the cap and the cartridge.

5 Claims, 5 Drawing Figures

Figures 1A, 1B:
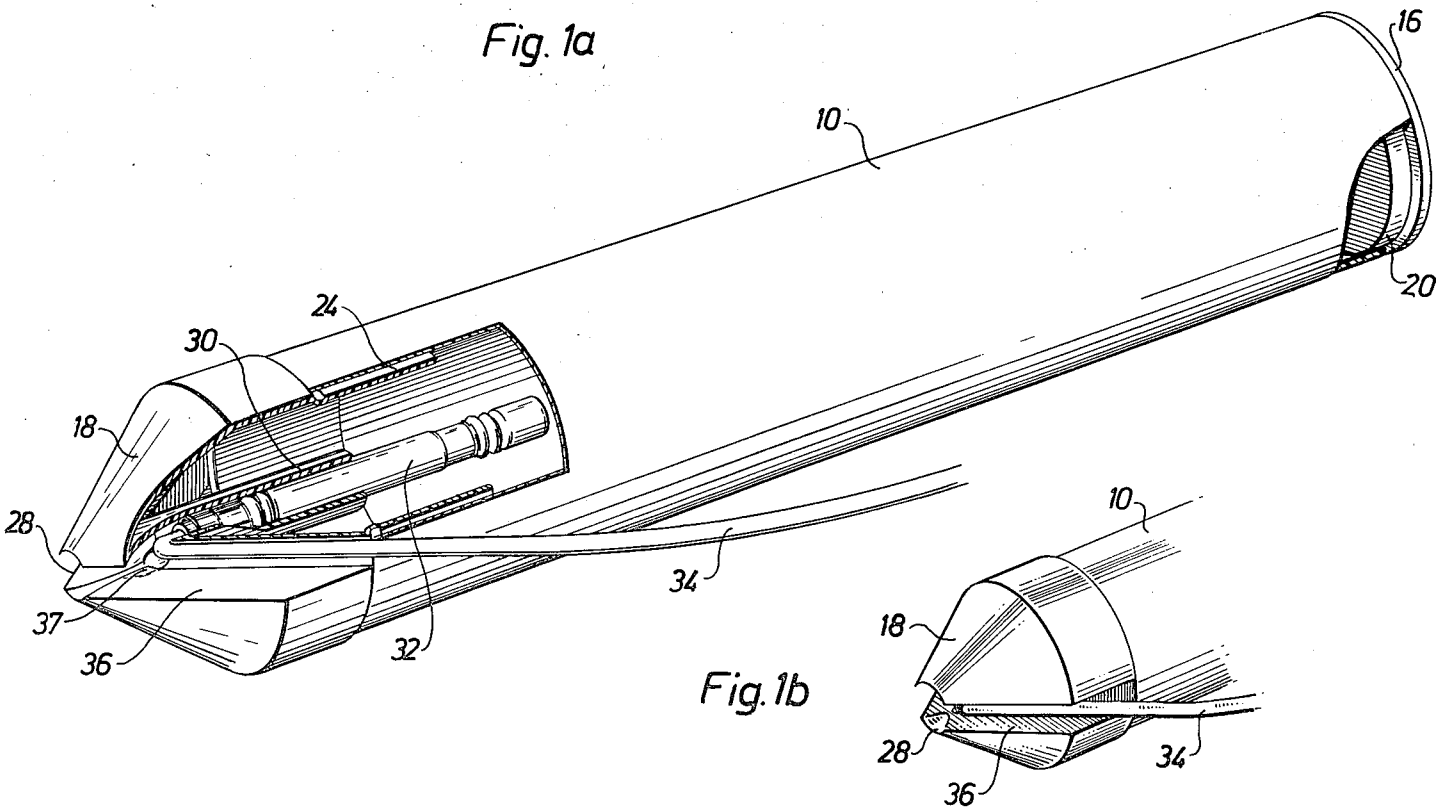

12
14
46
14
IIIb
IIIb
34
32
42
40
38
26
22
34
32
44
40
38
26
22

PRIMER

To initiate detonation of a charge of explosive in a blasthole, a detonator is normally required. This detonator contains approximately one gram of explosive charge, but for some types of explosive this is not sufficient. There are a number of types of explosive, e.g. mixtures of ammonium nitrate with a fuel (so-called ANFO explosives) and types containing a certain quantity of water to give them a plastic or pumpable consistency (so-called water-gel explosives) that require a more powerful charge or primer for initiation. For effective detonation, the primer must contain a high-density explosive having a detonation velocity exceeding that of the explosive with which the blast hole is charged.

In blast holes of small diameter, a conventional primer cartridge of the type sold under the trademarks "DYNAMIT" or "DYNAMEX", or similar explosive, is normally used. However, the detonating effect of the detonator is highly dependent on its position in the explosive cartridge. The cartridge is prepared for blasting by sticking the detonator into it, either from the end or from the side.

When using a primer of the above, known design, it is almost impossible to fix in advance the position the detonator is going to assume when inserted into the primer. The detonator may enter the primer at an angle, and it may be so unfortunately positioned as to considerably reduce its explosive power. This can occur, for example, if the detonator is not fully inserted into the primer, or if the detonator does not assume the position intended in relation to the explosive in the primer.

The ignition cable or fuse of the detonator is subjected to mechanical stresses during the operation of charging as it is propelled by the tamping rod or the hose of the charging machine into the blast hole and toward the bottom of the latter. Friction against the walls of the hole and the sharp edges of cracks in the rock or of loose rock splinters can damage the wire and impair the performance of the primer.

If the primer, or the primer charge into which the detonator is inserted, is too short in relation to the diameter of the bore hole, pulling on the ignition cable or fuse while introducing the primer into the hole may cause the latter to get caught across the width of the hole and break off. As well as being useless, a broken-off primer is always a safety hazard.

The principal object of the invention is to develop a primer of the type mentioned initially, in which the detonator is firmly fixed so as to obtain the optimum detonating effect, and where the detonator cannot be pulled out of place if the ignition cable or fuse should be pulled in the process of charging the blast hole.

It is a further object of the invention that the length and mechanical strength of the primer shall be such as to preclude its getting caught across the width of the hole and prevent any damage to the detonator. Moreover, the tip of the primer is shaped so as to protect the forwardmost and most easily damaged part of the ignition cable or fuse.

In other words, the invention is concerned with a primer designed to improve the blasting power of a detonator and containing an explosive charge enclosed in an essentially cylindrical casing with closed ends, one end being fitted with a device for centering and retaining the detonator in relation to the said casing. A primer of this type is to be characterized primarily by the device being so designed that the detonator—irrespective of its length—when in place in the primer, partly protrudes from the device into the explosive so as to be in direct contact with the latter, while an ignition cable or fuse, connected to that end of the detonator that is held inside the centering and retaining device, passes laterally along a specially shaped groove or channel so as to be protected against external force, at least at one end of the primer.

Figures 2, 3A, 3B:
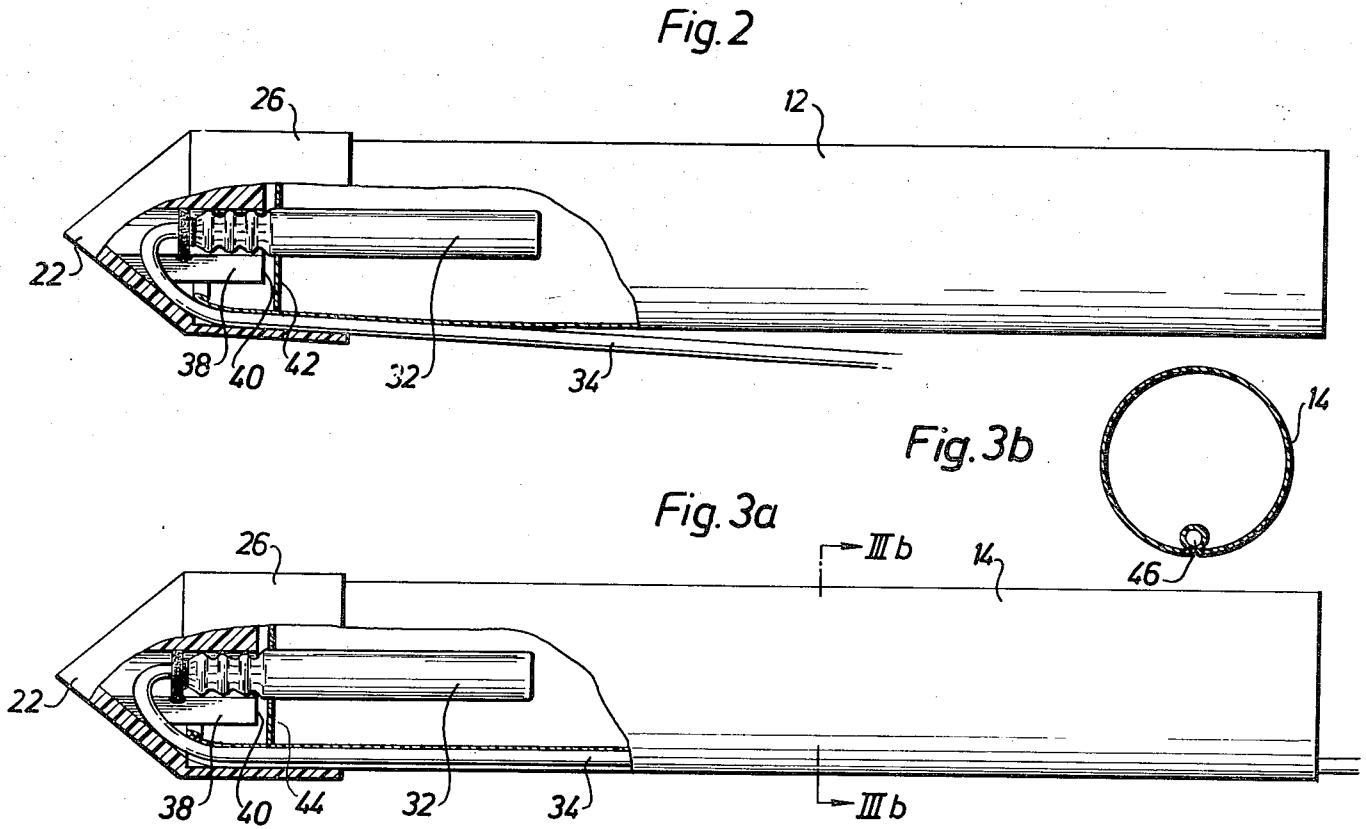

The invention will now be described in detail in the form of a number of examples of embodiments thereof, with reference to the accompanying drawings, wherein:

FIG. 1*a* is a perspective view of a first embodiment of a primer designed in accordance with the invention, with the detonator in place therein, and with parts of the primer being cut away to show the interior thereof;

FIG. 1*b* is a fragmentary perspective view similar to FIG. 1, but showing in full the forward end of this primer;

FIG. 2 is a side elevational view of a second embodiment of the new primer, with the detonator in place therein, and with part of this modified primer being cut away for illustrative purposes;

FIG. 3*a* is a side elevational view of a third embodiment of the new primer, with the detonator in place therein, and with part of this primer being cut away in the same way as in FIG. 2 to show the interior thereof; and FIG. 3*b* is a sectional view through the primer illustrated in FIG. 3*a*, looking in the direction indicated by the arrows in FIG. 3*a*.

Corresponding parts in the different figures are numbered the same.

The new primer, preferably made of plastic, comprises in all three of the illustrated embodiments a cylindrical casing, 10, 12 and 14, respectively, which accommodates a plastic explosive (not shown). The rear end of the casing 10 in FIG. 1*a* is closed by means of a substantially flat endpiece 16; and the forward end is closed by means of a pointed cap or endpiece 18. The rear endpiece 16 may, as also illustrated in FIG. 1*a*, be press fit into the casing 10, in which case the endpiece 16 will have thereon a cylindrical projection 20 that extends coaxially into the interior of the casing 10. The forward endpiece or cap 18 may also, as shown in FIG. 1*a*, be fixed in the casing 10 by means of an annular skirt part 24, which is inserted snugly in the casing; but the modified cap or endpiece 22, as appears from FIGS. 2 and 3*a*, may be fixed on the casing, 12 or 14, respectively, by means of an integral collar 26 which fits snugly over the casing.

In the embodiment illustrated in FIGS. 1*a* and 1*b* there is an opening 28 in the center of the forward endpiece 18, i.e. at the tip thereof. Protruding rearwardly or inwardly from the tip of endpiece 18, and forming a continuation of the opening 28, is a tubular socket 30, which is sized so as to accomodate a cylindrical detonator 32. The socket 30 is designed to serve as a guiding and retaining device for the detonator 32, so that the position of the detonator 32, after insertion into the primer, is always fixed and predictable.

When the detonator 32 has been pressed in through the opening 28 in the forward end of the cap 18, and is in place in the cylindrical socket 30, an ignition cable or fuse 34, which may be of either the NONEL ® type, an electrical type, a detonating fuse, or other fuse, and which is connected to the detonator 32, will pass out through the opening 28. To protect the ignition cable or fuse 34 against damage from stones and the like, for instance during insertion of the primer into a blast hole, a groove 36 in the cap is provided extending from the exterior of the opening 28 and along the end piece 18 to the rear edge thereof. For practical reasons the inclined groove 36 may be formed, as shown in FIGS. 1*a* and 1*b*, so that it runs down on two (opposite) sides of the said opening 28. When the detonator is inserted, the ignition cable or fuse 34 is bent over so as to be protected by a matching part of the groove 36. Spring catches 37 in the opening 28 retain the detonator in place after it is inserted.

The embodiments shown in FIGS. 2 and 3 have no opening for the ignition cable or fuse 34 in the tip of the cap or endpiece 22 opposite its cylindrical socket 38, which, as in the first embodiment, is integral with, and projects coaxially rearwardly from, the pointed end of the cap. Instead, the socket 38 is provided with a slit 40 extending for a suitable distance forward from the rear or open end of the socket 38. The detonator 32 and the ignition cable or fuse 34 are inserted from the rear into the socket 38, which serves as a locating and retaining device, the ignition cable or fuse 34 passing through the slit 40. Naturally the endpiece 22 is detached from the body of the primer during this operation, and is not placed on the cylindrical casing, 12 or 14, respectively, until the detonator 32 is mounted in the socket 38. To provide adequate protection for the explosive during this stage, there is an inner wall, 42 (FIG. 2) or 44 (FIG. 3*a*), respectively, which isolates the explosive from the exterior. With this arrangement, the front endpiece 22 and the detonator 32 may be combined in a unit that is supplied separately and not mounted on the body 12 or 14 of the primer until the latter is to be prepared for blasting. The said walls, 42 and 44 respectively, may be intact when supplied and provided with an indication (not illustrated) at the point where the detonator 32 is to be inserted. These walls also help to support the associated detonator 32 in a predetermined position radially of the associated body 12 or 14.

When the forward endpiece 22, bearing the detonator 32, is mounted on the cylindrical casing, 12 or 14 respectively, the ignition cable or fuse 34 will pass between the casing and the collar 26 of the endpiece 22. The cable or fuse 34 is thus very well protected in this embodiment, as appears from FIG. 2. However, if it is desired to obtain further protection of the cable or fuse along a greater part of its length, one or more longitudinally extending grooves such as at 46 may be provided within the shell of the cylindrical case 14. The groove 46 may be formed as shown in FIG. 3*b*, in which case the cable or fuse 34 will be well protected inside the groove 46 once it is pressed into the latter. In the embodiment of FIG. 3 the cable or fuse is thus protected for the entire length of the primer.

The primer described above can naturally be modified within certain limits. One might, for instance, form the cylindrical socket as a unit with the cylindrical case instead of with the front endpiece. The socket illustrated in the figures is shown with its rear end open. However, this end might, when supplied, be covered with a thin layer of plastic or similar material, possibly cut through or otherwise weakened. The essential point is that when the detonator is inserted it can be easily forced through the said end, and is held so that at least part of the detonator comes in direct contact with the explosive in the primer. Further, one might consider an embodiment in which the pointed tip is so designed that before the primer and detonator are united in preparation for blasting, the said tip serves as a centering element for the detonator in the case where the cable or fuse of the latter is wound in a coil.

Having thus described my invention what I claim is:

1. A primer intended to reinforce the explosive power of a detonator, comprising, a cylindrical casing having closed ends and containing an explosive, and a device on one of said ends of said casing for centering and frictionally retaining a detonator in a predetermined position in relation to said casing, said device having thereon a cylindrical tube extending axially of said casing with one end of said tube in communication with the bore in said casing, and with the opposite end of said tube being spaced axially inwardly from the outer end of said device and registering with a central opening in said outer end of said device, said tube having an axial bore disposed to receive and fit snugly around and envelop the peripheral surface of said detonator adjacent one end thereof so that the detonator, irrespective of its length, when retained in said tube, partly protrudes at its opposite end from said tube into direct contact with the explosive in said casing, said device having in its outer surface an open groove for guiding an ignition fuse, which projects from the detonator that is retained in said tube, said groove communicating at one end with said central opening in said device, and with said opposite end of said tube, and extending laterally and rearwardly thereof to guide said fuse rearwardly and beneath the outer surface of said device so as to be protected thereby against external forces at least adjacent said one end of the casing.

2. A primer as in claim 1, wherein said device is a cap, said tube is integral with said cap, and said cap is positioned over and projects in the form of a point beyond said one end of the casing.

3. A primer as in claim 1, wherein at least a portion of said device is integral with said casing.

4. A primer as in claim 2, wherein said tube is disposed coaxially with the central axis of the casing.

5. A primer as in claim 4, wherein said tube communicates with a central opening in said cap through which the detonator is inserted into said tube, and said guiding groove comprises at least one radial groove formed in said cap to open at one end on said central opening in said cap, and at its opposite end on the side of said cap.

* * * * *